United States Patent [19]

Lubraniecki

[11] Patent Number: 4,811,453

[45] Date of Patent: Mar. 14, 1989

[54] VACUUM CLEANER WITH AN AIRTIGHT FLEXIBLE BAG

[76] Inventor: Jacques Lubraniecki, 58 avenue de Lattre de Tassigny, 54000 Nancy, France

[21] Appl. No.: 209,566

[22] Filed: Jun. 21, 1988

[30] Foreign Application Priority Data

Jun. 25, 1987 [FR] France ..... 87 08945

[51] Int. Cl.[4] ..... A47L 9/14

[52] U.S. Cl. ..... 15/347; 15/352; 15/353; 55/429

[58] Field of Search ..... 15/347, 352, 353; 55/429, 378

[56] References Cited

U.S. PATENT DOCUMENTS

| | | | |
|---|---|---|---|
| 3,034,273 | 5/1962 | Wallace | 15/353 X |
| 3,653,190 | 4/1972 | Lee et al. | 55/429 X |
| 3,755,992 | 9/1973 | Ylinen | 55/429 X |
| 3,961,921 | 6/1976 | Heiman et al. | 55/429 |
| 4,523,936 | 6/1985 | Disanza | 15/352 X |

FOREIGN PATENT DOCUMENTS

| | | |
|---|---|---|
| 1219610 | 12/1959 | France . |
| 1396325 | 4/1975 | United Kingdom . |
| 2141635 | 3/1985 | United Kingdom . |

*Primary Examiner*—Chris K. Moore

*Attorney, Agent, or Firm*—Gerald J. Ferguson, Jr.

[57] ABSTRACT

The vacuum cleaner of the invention comprises a sealed enclosure having a suction orifice and an exhaust orifice, a dirt bag (19) disposed inside the enclosure and having an opening facing the suction orifice, and a suction device (8) disposed facing a closed end of the dirt bag opposite from the suction orifice. The vacuum cleaner is characterized in that the dirt bag is an airtight bag and in that the bag support includes an air-permeable inside surface which is in communication with an intermediate zone of at least one suction duct (11) having one end opening out in the vicinity of the suction device and having an opposite end opening out in the vicinity of the suction orifice.

5 Claims, 2 Drawing Sheets

VACUUM CLEANER WITH AN AIRTIGHT FLEXIBLE BAG

The present invention relates to a vacuum cleaner with an airtight flexible bag.

BACKGROUND OF THE INVENTION

Two main types of vacuum cleaner are known at present. The first type of vacuum cleaner, which is the most widespread, includes a flexible bag which is permeable to air and which is disposed in an airtight enclosure between a suction orifice and a suction device. Air sucked by the suction device flows through the wall of the flexible bag which then acts as a filter and retains the dirt contained in the sucked-in air. Such a vacuum cleaner is not suitable for sucking up a liquid since the liquid would flow through the pores of the flexible bag, nor can it be used with damp substances which would very quickly clog the pores of the flexible bag. Further, flexible bags are either made of cloth, in which case it is necessary to empty them out in order to reuse them and this is a particularly disagreeable operation to perform, or else they are made of paper, in which case they are fragile and may tear while being handled which makes it necessary to clean out the vacuum cleaner itself and to vacuum back up the dirt which has fallen onto the ground.

In the second type of vacuum cleaner, a rigid receptacle is disposed in an airtight enclosure with an opening facing the suction orifice, and the suction device is disposed on a side opposite to said opening. The air sucked by the suction device flows around the rigid receptacle while the dirt is projected, generally under gravity, into the rigid receptacle. Although such a vacuum cleaner is capable of picking up wet dirt and even liquids, it is still necessary to transfer the contents of the rigid receptacle into a garbage bin. Such a device is therefore unsuitable for vacuuming harmful particles or substances that redisperse in the atmosphere during handling, such as asbestos for example. Attempts have indeed been made to dispose an airtight flexible bag in the rigid receptacle, but it has been observed that the bag is then sucked into the suction device when the device is switched on, and as a result it is not possible to use an airtight flexible bag in existing vacuum cleaners.

An object of the present invention is to provide a vacuum cleaner in which the dirt is directly collected in an airtight flexible bag.

SUMMARY OF THE INVENTION

In order to achieve this object, the present invention provides a vacuum cleaner comprising a sealed enclosure including a suction orifice and an exhaust orifice, a support for a dirt bag disposed inside the enclosure, the dirt bag having an opening facing the suction orifice, and a suction device disposed facing a closed end of the dirt bag opposite from the suction orifice, wherein the dirt bag is an airtight bag and the bag support includes an internal surface which is permeable to air and in communication with an intermediate zone of at least one suction duct having one end opening out in the vicinity of the suction device and having its opposite end opening out in the vicinity of the suction orifice.

Thus, when the vacuum cleaner is switched on, the suction device causes the dirt bag to be sucked against the internal surface of the dirt bag support, thereby holding the bag in the fully-opened position. When the bag is full, it can be removed after the suction device has been switched off, and optionally after being closed or even sealed while still in the vacuum cleaner.

In an advantageous version of the invention, the bag support comprises a side wall having longitudinal grooves communicating laterally with the inside surface of the support and each having one end connected to a space adjacent to the suction device and an opposite end connected to a suction manifold. The side wall of the dirt bag is thus suitably maintained pressed against the internal face of the dirt bag support.

According to a preferred aspect of this version of the invention, the grooves have respective slots which are narrower than the maximum transverse dimensions of the grooves. The head loss in the grooves is thus kept to a minimum while ensuring that the dirt bag is effectively maintained against the inside wall of the support.

According to another advantageous embodiment of the invention, the bag support includes an internal annular layer made of an air-permeable material having one end connected to a space adjacent to the suction device and having an opposite end connected to a suction manifold. The permeable substance thus constitutes a multiplicity of suction channels which ensure that the dirt bag is held uniformly.

According to another aspect of the invention, the bag support includes a screen-forming side wall. Thus, the space surrounding the dirt bag constitutes an annular duct in communication with the internal face of the support via each of the holes constituting the screen.

BRIEF DESCRIPTION OF THE DRAWINGS

Embodiments of the invention are described by way of example with reference to the accompanying drawings, in which.

MORE DETAILED DESCRIPTION

Figure 1:
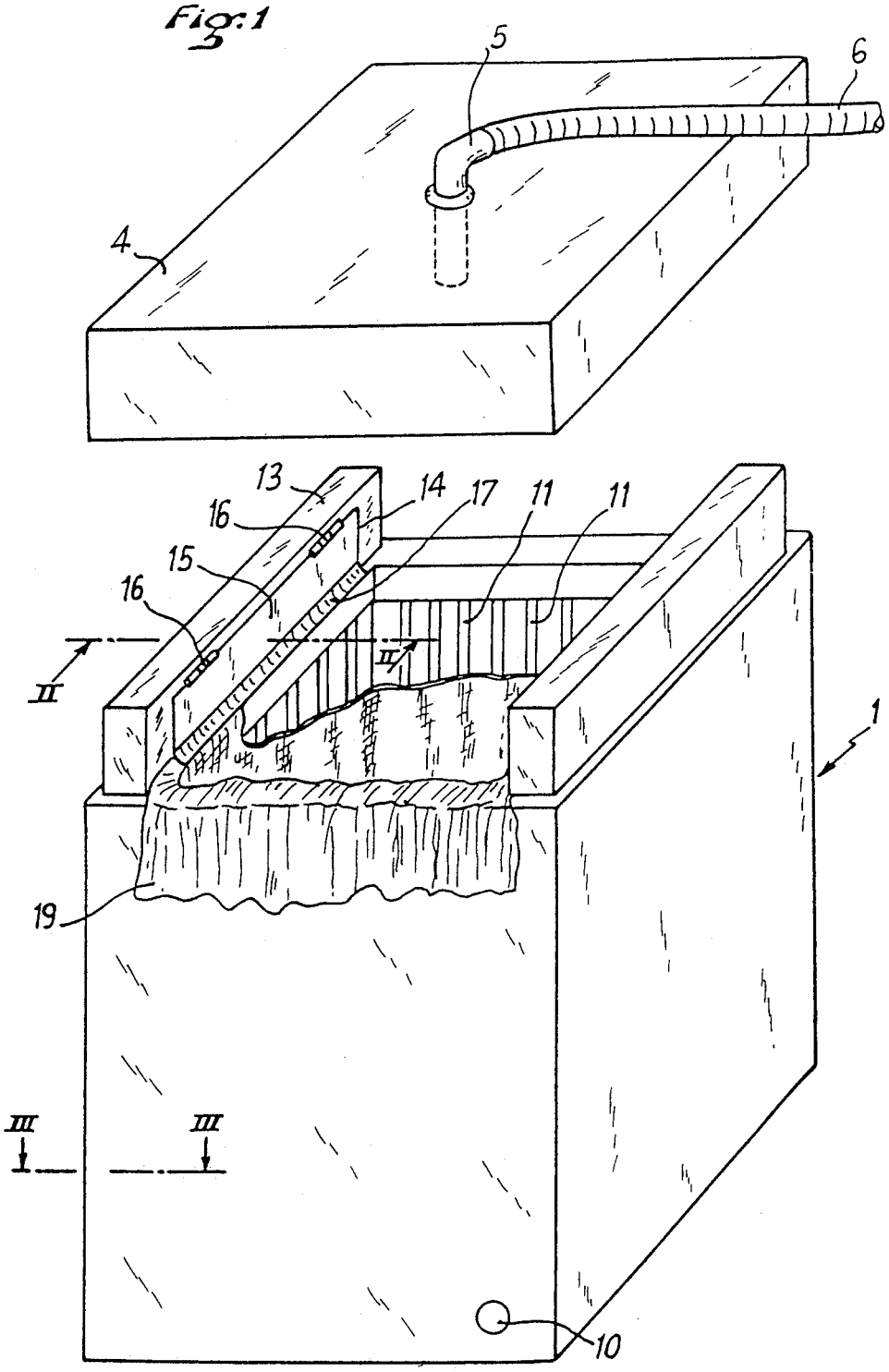
FIG. 1 is a perspective view of a first embodiment of the invention.
Figure 2:
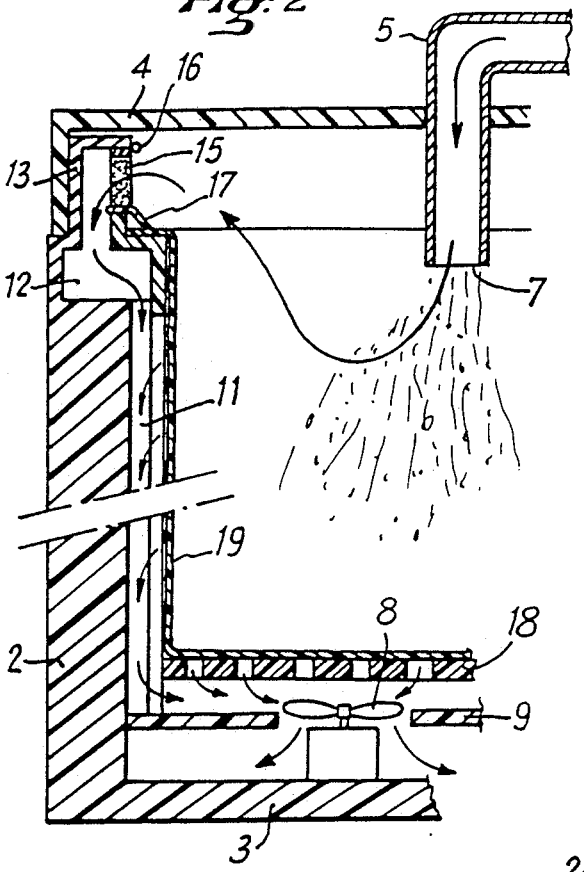
FIG. 2 is a fragmentary section on line II—II of FIG. 1.
Figure 3:
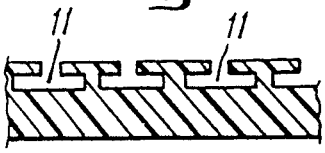
FIG. 3 is a fragmentary section on line III—III of FIG. 1.

With reference to FIGS. 1 to 3, a vacuum cleaner in accordance with the invention comprises a tank given general reference 1 having a side wall 2 which is connected in airtight manner to a bottom 3. A lid 4 is designed to engage the top of the tank 5 so as to form an airtight enclosure therewith. A suction tube 5 associated in conventional manner with a flexible pipe 6 passes through the lid 4. On the inside, the suction tube 5 includes a suction orifice 7.

A suction device 8, for example an electric fan, is disposed inside the tank 1 at the bottom thereof. A separating partition 9 surrounds the suction device 8 so that the suction device causes air to flow inside the enclosure from the suction orifice 7 towards an exhaust orifice 10 provided in the wall of the tank 1 at a level beneath the partition 9. Where appropriate, the exhaust orifice 10 is provided with a non-return valve to prevent foreign bodies penetrating into the vacuum cleaner.

In the embodiment shown in FIGS. 1 to 3, the side wall 2 of the tank 1 has a series of longitudinal vertical grooves 11 on its inside, said grooves having a Tee-shaped section with the horizontal bar of the Tee extending parallel to the wall 2 and with its vertical bar extending transversely towards the inside of the tank and opening out via a narrow slot in the inside surface of the tank. The grooves 11 extend from the intermediate plate 9 up to a suction manifold channel 12 which extends around the top of the tank 1. On two sides of the tank 1, the suction manifold channel 12 is connected to two filter-carrier blocks 13 projecting upwards from the suction manifold channel 12 and including openings 14 facing the inside of the tank and receiving filter blocks 15. In the illustrated preferred embodiment, the blocks 15 are mounted in the openings 14 by means of hinges 16 and have lips 17 running along the bottoms thereof and bearing against the top face of the manifold channel 12.

The tank includes a perforated plate 18 disposed above the suction device 8 and spaced apart from the intermediate partition 9. An airtight flexible dirt bag 19, for example a conventional plastic garbage bin liner is disposed inside the tank, with its edge facing the filter carrier blocks being engaged beneath the lips 17 of the filter blocks 15, and with its other edges being folded over the top edges of the side walls of the tank 1, for example.

This embodiment works as follows: after the airtight flexible bag 19 has been installed, the lid is placed on the tank so as to form an airtight enclosure and the motor of the suction device is switched on. The suction set up by the suction device 8 is initially transmitted to the portions closest thereto, i.e. to the perforations through the plate 18. Because the dirt bag 19 is airtight, the bottom of the bag is sucked down until it comes into contact with the plate 18. Suction then propagates along the grooves 11 and attracts the side wall of the dirt bag 19 via the lateral slots of the grooves 11. Once the side wall of the dirt bag 19 is pressed against the inside surface of the side wall 2 of the tank, suction propagates to the inside of the dirt bag 19 via the suction manifolds 12 and the filter blocks 15. It should be observed that by virtue of the head loss in the grooves 11 and the filter blocks 15, the suction established inside the dirt bag 19 is less than the suction in the vicinity of the suction device 8 and in the grooves 11. The dirt bag 19 is therefore continuously urged against the inside surface of the tank 9 so long as the suction device is in operation.

Under these conditions, air is sucked in conventional manner through the suction opening 7 and dirt falls under gravity into the dirt bag 19 while the sucked-in air is filtered by the filter blocks 15 and is then exhausted via the exhaust orifice 10.

When the suction device 8 is switched off, the lid can again be removed and the dirt bag 19 can be closed while it is still in position in the tank. The dirt is therefore suitably packaged prior to being handled.

Figure 4:
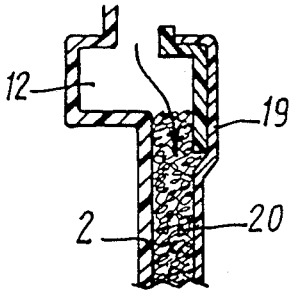
FIG. 4 is a fragmentary view similar to FIG. 2 showing another embodiment.

FIG. 4 shows a variant of the embodiment shown in FIGS. 1 to 3, in which the grooves 11 are replaced by an internal annular layer 20 of air-permeable material, for example a layer of open-cell foam or, better still, a layer of non-woven cloth having a low fiber content. The permeable material provides an extremely large number of channels between the side wall 2 of the tank and the airtight wall of the waste bag 19, and as a result operation is analogous to that described for the preceding embodiments.

Figure 5:
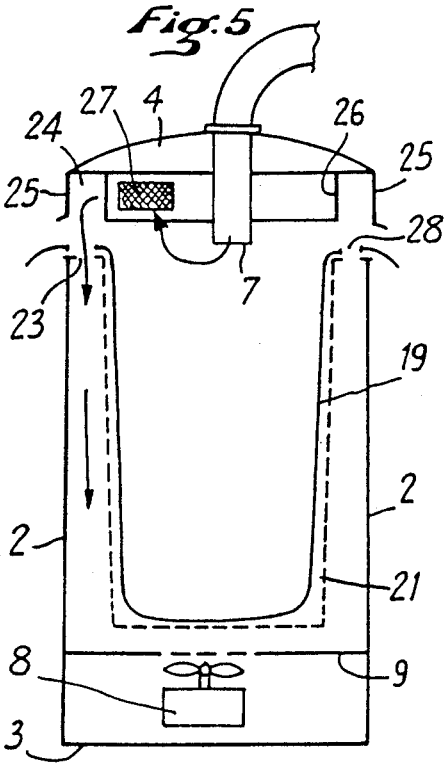
FIG. 5 is a diagrammatic section of another embodiment of the invention.
Figure 6:
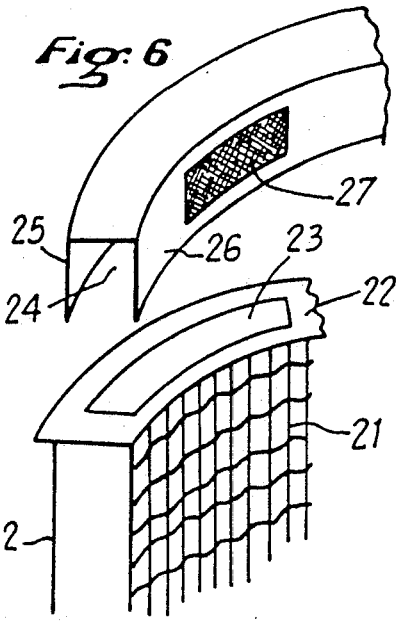
FIG. 6 is a diagrammatic fragmentary perspective view of the FIG. 5 embodiment.

In the above-described embodiments, the side wall 2 of the tank serves simultaneously as an airtight wall forming the outer enclosure and as a wall having an air-permeable inside surface for supporting the dirt bag. FIGS. 5 and 6 are highly diagrammatic and show another embodiment in which the support for the dirt bag is constituted by a basket 21 constituting a screen or grille disposed inside the tank above the intermediate partition 9. The top portion of the basket 21 is connected to the side wall 2 via an annular wall 22 including openings 23 which face an annular suction manifold 24 provided in the lid 4 between an outer rim 25 and an internal annular wall 26 pierced by openings containing filter blocks 27.

The annular space surrounding the basket 21 performs the same function as the channels formed by the grooves 11 in the preceding embodiment, and the throttling via the openings 23 and the filter blocks 27 provides sufficient head loss to ensure that the suction surrounding the airtight dirt bag 19 is always greater than the suction inside said bag, thereby ensuring that the bag is permanently pressed against the inside surface of the basket 21. Naturally, when the edge of the dirt bag 19 is folded down over the top portion of the basket 21, as shown in FIG. 5, it should not be forgotten to make holes 28 through the wall of the bag level with the openings 23 in order to allow air to pass from the suction manifold 24 towards the suction device 8.

Naturally, the person skilled in the art will be able to provide variants of the invention without going beyond its scope defined by the claims. In particular, although the grooves 11 have been shown as being Tee-shaped in section, they could be of any other shape which may be desirable for manufacturing reasons. In particular, the grooves 11 could have a circular section or a dovetail section. It is preferable for the width of the communicating side slot of the grooves to be less than the maximum groove width, thereby ensuring that the groove does not give rise to excessive head loss while simultaneously ensuring that the side wall of the dirt bag 19 cannot penetrate into a groove.

The tank itself may also be of any desired shape, in particular it may be in the form of a circular section cylinder as is conventional for vacuum cleaners. It may also be observed that the grooves 11 could be replaced by tubes extending vertically and having perforated side walls facing the dirt bag 19.

In the embodiments described, it should also have been observed that the airtight bag 19 is pressed not only against a bottom wall but also over its entire side wall. In practice, it could be held in place in zones which are more localized and situated between the suction opening and the suction device, by providing suction ducts which open out locally to the internal surface of the bag support.

Although the suction device in the embodiments described is constituted by a fan disposed underneath the dirt bag, the fan (or any other suction means) could be disposed to one side of the bag or above the bag in order to keep it out of the way of liquid which could flow by accident through a tear in the bag, in which case the suction device would include a duct in order to convey the main suction to the outside of the dirt bag in order to ensure that there is always a portion of the bag wall extending over an intermediate zone between a suction end of the suction device and the suction orifice.

Although the sack for collecting the sucked-in substances has been referred to as a "dirt" bag, it should be observed that the device of the invention can also be used for sucking up and collecting particles which are clean, and that this application is therefore not excluded from the protection provided by the claims.

I claim:

1. A vacuum cleaner comprising an airtight enclosure having a suction orifice, an air-permeable support disposed inside the enclosure for receiving an airtight bag, said bag having an opening facing the suction orifice, a suction device, suction ducts each having a first end opening out in the vicinity of the suction orifice on the inside of the bag and having a second end opening out in the vicinity of the suction device, and an exhaust orifice connected to the suction device, wherein the suction ducts extend around the bag support and are in communication with the outside of the bag in an intermediate zone between their first and second ends.

2. A vacuum cleaner according to claim 1, wherein the bag support comprises a side wall having longitudinal grooves communicating laterally with the inside surface of the support and each having one end connected to a space adjacent to the suction device and an opposite end connected to a suction manifold.

3. A vacuum cleaner according to claim 2, wherein the grooves have respective slots which are narrower than the maximum transverse dimensions of the grooves.

4. A vacuum cleaner according to claim 1, wherein the bag support includes an internal annular layer made of an air-permeable material having one end connected to a space adjacent to the suction device and having an opposite end connected to a suction manifold.

5. A vacuum cleaner according to claim 1, wherein the bag support includes a screen-forming side wall.

* * * * *